US006736212B2

(12) United States Patent
Liew

(10) Patent No.: US 6,736,212 B2
(45) Date of Patent: May 18, 2004

(54) DRILLING ALIGNMENT SYSTEM

(75) Inventor: Joseph Shu Yian Liew, Singapore (SG)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/232,276

(22) Filed: Aug. 29, 2002

(65) Prior Publication Data

US 2003/0062168 A1 Apr. 3, 2003

Related U.S. Application Data

(60) Provisional application No. 60/317,749, filed on Sep. 6, 2001, and provisional application No. 60/315,609, filed on Aug. 29, 2001.

(51) Int. Cl.[7] ..... E21B 43/12

(52) U.S. Cl. ..... 166/313; 166/382; 166/97.5

(58) Field of Search ..... 166/313, 52, 380, 166/382, 77.1, 97.5

(56) References Cited

U.S. PATENT DOCUMENTS 330,355 A * 11/1885 Yancy ..... 56/241
4,136,996 A 1/1979 Burns
5,458,199 A * 10/1995 Collins et al. ..... 166/313
5,560,435 A 10/1996 Sharp
5,685,373 A 11/1997 Collins et al.
5,865,260 A 2/1999 Jackson et al.
5,918,675 A * 7/1999 Borak et al. ..... 166/349

OTHER PUBLICATIONS

Teel, Mark E., "Drill Multiple Wells From One Surface Wellbore," World Oil, Nov. 1993, pp. 25 and 36.

* cited by examiner

*Primary Examiner*—David Bagnell
*Assistant Examiner*—Dan Stephenson
(74) *Attorney, Agent, or Firm*—Henry C. Query, Jr.

(57) ABSTRACT

A method for drilling a plurality of well bores through a single conductor housing which comprises providing a base plate which includes at least first and second well slots that extend therethrough, supporting the base plate on the conductor housing, suspending a temporary casing string from the first well slot, drilling a first well bore through the second well slot, removing the temporary casing string from the first well slot, and then drilling a second well bore through the first well slot.

15 Claims, 14 Drawing Sheets

DRILLING ALIGNMENT SYSTEM

This application is based on U.S. Provisional Patent Application No. 60/315,609, which was filed on Aug. 29, 2001, and U.S. Provisional Patent Application No. 60/317,749, which was filed on Sep. 6, 2001.

BACKGROUND OF THE INVENTION

The present invention is directed to a system for completing multiple hydrocarbon wells. More particularly, the invention is directed to a system and method for guiding a drill string during the drilling of multiple well bores in a side-by-side wellhead system.

In the oil and gas industry, side-by-side ("SXS") wellhead systems, or multiple completion systems, are commonly used to drill and complete a number of hydrocarbon wells from within a single conductor housing. In such systems, multiple casing strings are run through the same conductor housing in order to reduce cost and space requirements. As shown in FIG. 1, a prior art SXS wellhead system may comprise a drive pipe housing A which is welded to the top of a conductor housing B, two or more casing strings C which are each suspended from the drive pipe housing, and a base plate D which is bolted to the top of the drive pipe housing. In this example, the well on the right is covered by an abandonment cap E, and a wellhead F is installed in the well on the left. In the drilling mode of operation of the SXS wellhead system, a drilling riser G may be bolted to the top of the wellhead F or connected directly to the base plate D.

One difficulty with SXS wellhead systems arises in the need to align and guide the drill string while drilling the well bores for the individual casing strings. If the first well bore is drilled too close to the center of the conductor housing, insufficient space will exist for the remaining well bores. One solution to this problem is disclosed in U.S. Pat. No. 6,142,235 to Monjure et al., which teaches using a permanently installed drilling guidance device in the conductor housing. However, this guidance device must be specially fabricated for each specific application, and this can be both costly and time consuming. Moreover, the guidance device must be permanently installed in the conductor housing, which requires that the cost for each guidance device be born for each SXS completion.

SUMMARY OF THE INVENTION

These and other disadvantages in the prior art are addressed by providing a system and method for drilling a plurality of well bores through a single conductor housing. The method comprises providing a base plate which includes at least first and second well slots that extend therethrough, supporting the base plate on the conductor housing, suspending a temporary casing string from the first well slot, drilling a first well bore through the second well slot, removing the temporary casing string from the first well slot, and then drilling a second well bore through the first well slot.

In accordance with one embodiment of the invention the diameter of the temporary casing string is larger than the diameter of a casing string which is subsequently suspended in the first well slot during completion of a well through the second well bore. In accordance with another embodiment of the invention, the temporary casing string is suspended from an offset casing hanger. Furthermore, individual lengths of the temporary casing string may be connected together by connector collars which have a larger diameter than the diameter of the temporary casing string.

Thus, the present invention comprises an economical method for guiding a drill string during the drilling of individual well bores in an SXS or multiple completion wellhead system. Since the diameter of the temporary casing string is larger than that of a subsequently installed casing string, sufficient room will exist after drilling the first well bore to drill the remaining well bores. In addition, because the temporary casing string is suspended from an offset casing hanger, the diameter of the temporary casing string can be significantly larger than the diameter of the subsequently installed casing string. Furthermore, after all the well bores have been drilled, the offset casing hanger and temporary casing string can be removed from the well. Consequently, these components can be reused on other multiple well completions.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
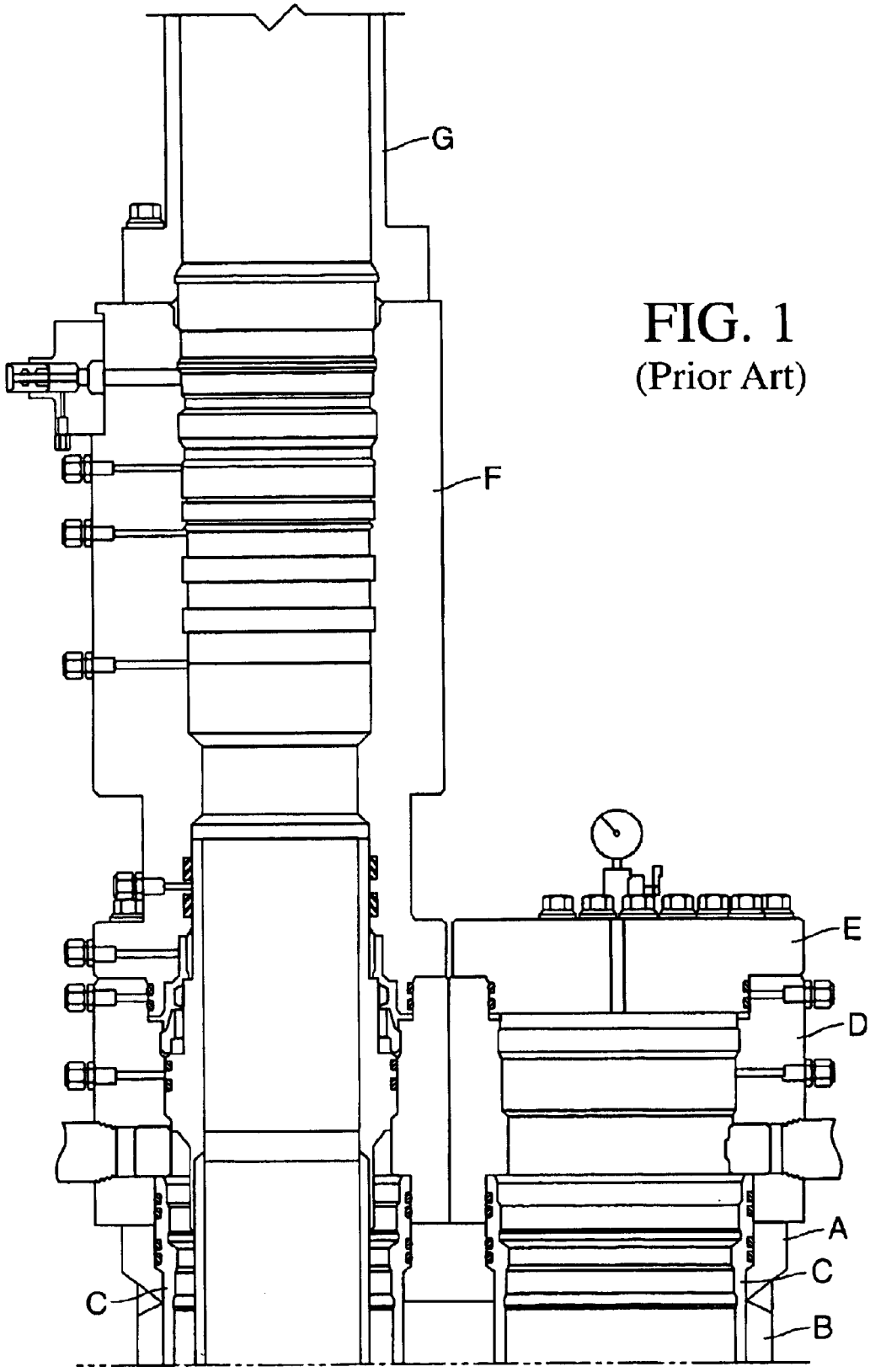
FIG. 1 (Prior Art)
FIG. 1 is a cross sectional view of a prior art SXS wellhead system.
Figure 2:
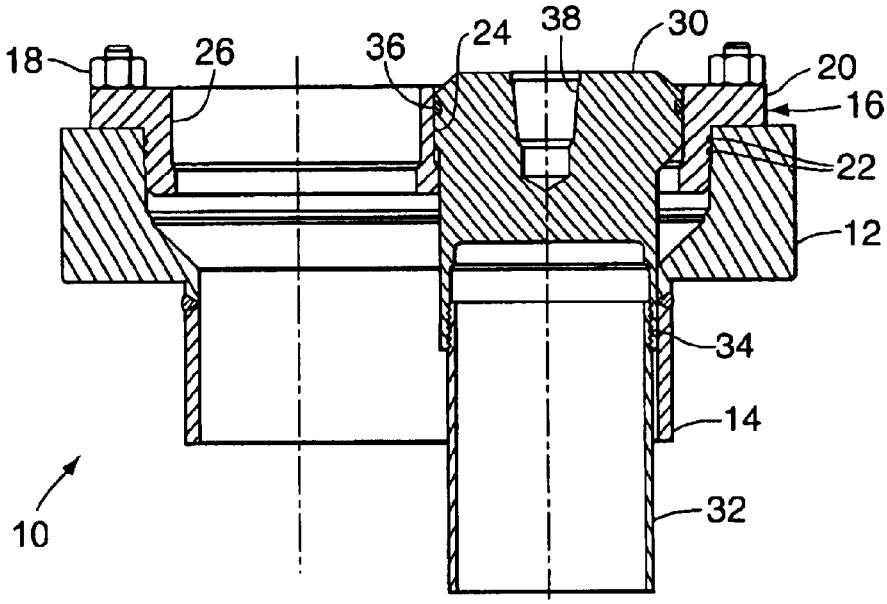
FIGS. 2 and 3 are a cross sectional view and a top view, respectively, of the drilling alignment system of the present invention with an offset casing hanger and a placeholder casing string installed in the right-hand well slot.
Figure 3:
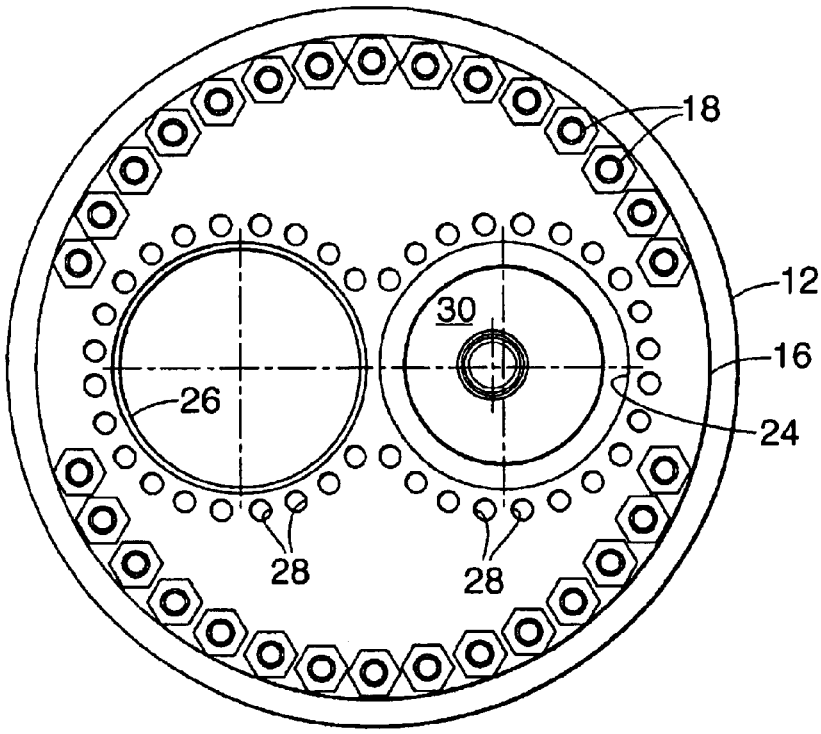

Referring to FIGS. 2 and 3, the drilling alignment system of the present invention may be used in conjunction with an exemplary SXS wellhead system 10 which comprises a drive pipe housing 12 that is attached to a conductor housing or pipe 14 by any suitable means, such as welding. In accordance with the present invention, a base plate 16 is attached to the drive pipe housing 12 with a number of studs and nuts 18. The base plate 16 preferably comprises a radial lip 20 by which the base plate may be suspended in the drive pipe housing 12 to ensure that the weight of any subsequently installed wellheads is transferred directly to the conductor pipe 14. A number of preferably elastomeric seals 22 are ideally provided to seal between the base plate 16 and an internal seal bore which is formed on the inner diameter of the drive pipe housing 12. In the illustrated embodiment of the invention, the base plate 16 is shown to comprise two annular bowl profiles 24 and 26, each of which is formed by a bore that extends through the base plate and defines a corresponding well slot therein. In addition, for reasons which will be made apparent below, the base plate 16 preferably includes a plurality of tapped holes 28 that extend into its top surface around each of the bowl profiles 24, 26.

In accordance with the present invention, an offset casing hanger 30 suspending a string of oversize casing 32 is run through the well slot 24 and landed on the base plate 16. If desired or required, an initial bore may drilled through the well slot 24 prior to running the oversize casing 32. The oversize casing 32 is connected to the offset casing hanger 30 via a conventional threaded connection 34. The offset casing hanger 30 is machined off-center and is oriented in the bowl profile 24 using a conventional key and slot arrangement (not shown). Thus, as shown in FIG. 2, the centerline of the casing hanger 30 is offset toward the centerline of the conductor pipe 14. The offset casing hanger 30 is preferably sealed to the bowl profile 24 with a suitable seal, such as an elastomeric belt type packing 36, and is provided with a hole 38 which is adapted to accept any straight thread or pipe thread as may be necessary.

The offset casing hanger 30 and the oversize casing 32 serve to ensure that sufficient space exists to drill out the final well bore and run and set a final casing string through the well slot 24 after a first well bore has been drilled through the well slot 26. The diameter of the oversize casing 32 is selected so that it will occupy at least as much space in the conductor housing as may be required to drill out the well bore for the final casing string at a later time. In addition, since the centerline of the offset casing hanger 30 is offset toward the centerline of the conductor pipe 14, the offset casing hanger is capable of suspending casing which is larger in diameter than the final casing string. The oversize casing 32 and the offset casing hanger 30 are ideally left in place in the SXS wellhead system 10 until such time as the well is reclaimed for completion through the well slot 24.

Figure 4:
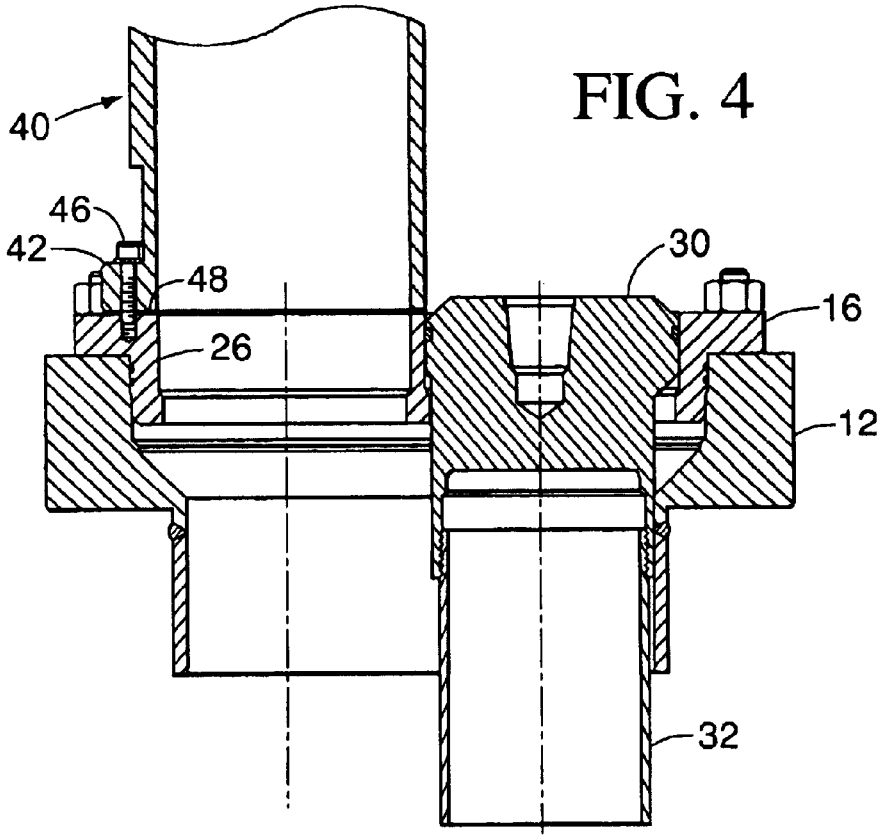
FIGS. 4 and 5 are a cross sectional view and a top view, respectively, of the drilling alignment system of FIG. 2 with a drilling riser installed over the left-hand well slot.
Figure 5:
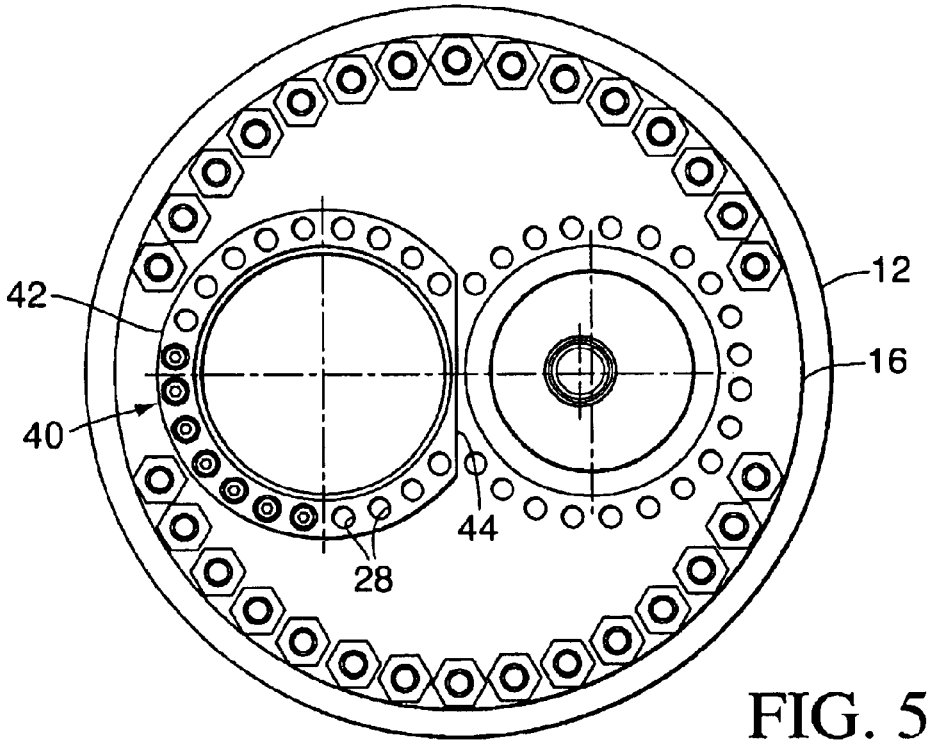

Referring to FIGS. 4 and 5, a drilling riser 40 is lowered over the empty bowl profile 26 in preparation for drilling out a well bore and running a final casing string through this well slot. The drilling riser 40 comprises a generally D-shaped flange 42 which includes a flat or truncated portion 44. The flange 42 is aligned with the holes 28 in the base plate 16 and is secured thereto with a number of bolts 46. A preferably elastomeric face seal 48 is provided to seal between the drilling riser 40 and the base plate 16 during drilling of a well bore through the well slot 26.

Figure 6:
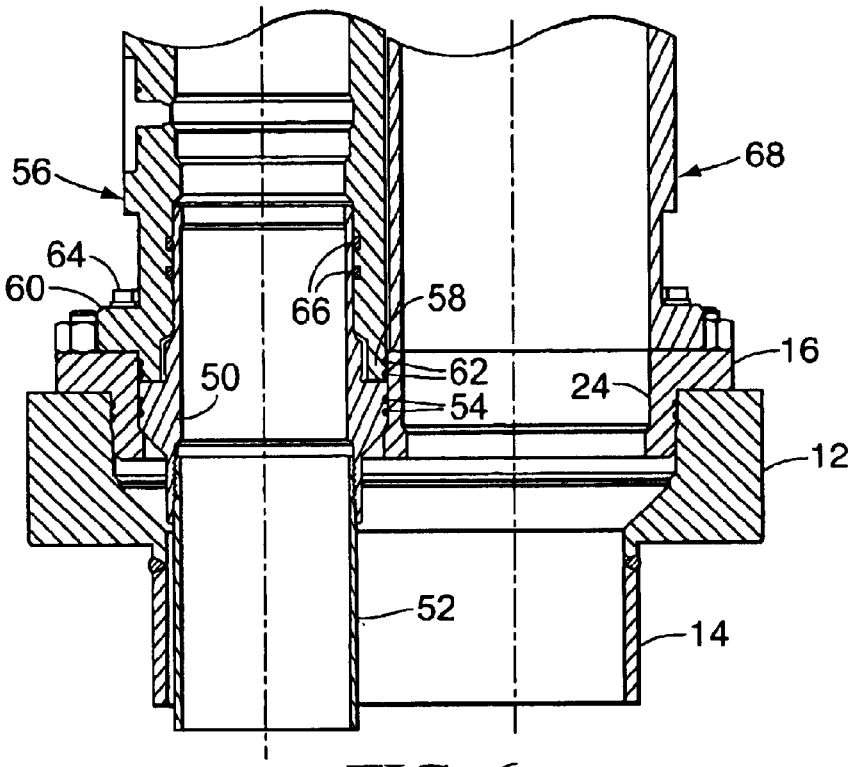
FIGS. 6 and 7 are a cross sectional view and a top view, respectively, of the drilling alignment system of FIG. 2 with a wellhead and a mandrel casing hanger installed in the left-hand well slot and a drilling riser installed over the right-hand well slot.
Figure 7:
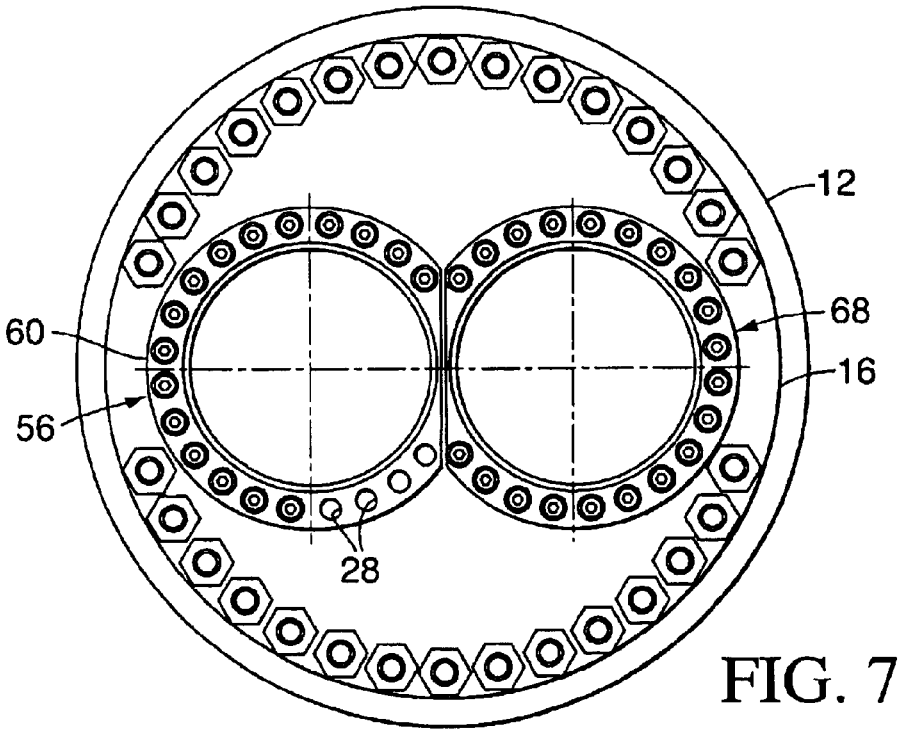

As shown in FIGS. 6 and 7, after a well bore is drilled through the well slot 26, a mandrel casing hanger 50 is landed in the bowl profile through the drilling riser 40. The mandrel casing hanger 50 is machined concentric about its centerline and suspends a final casing string 52 within the conductor pipe 14. Preferably two ideally elastomeric seals 54 are provided to seal between the mandrel casing hanger 50 and the bowl profile 26.

After the mandrel casing hanger 50 is installed, the drilling riser 40 is removed and a wellhead 56 is landed over the mandrel casing hanger. The wellhead 56 comprises an axially depending nose 58 and a generally D-shaped bottom flange 60. The nose 58 engages the top of the mandrel casing hanger 50 to prevent vertical movement of the hanger due to thermal expansion. A number of seals 62 are ideally provided on the outer diameter of the nose 58 to seal the wellhead 56 to the bowl profile 26. The bottom flange 60 of the wellhead 56 is aligned with the bolt holes 28 in the base plate 16 and is secured thereto with bolts 64. If required, suitable seals 66 may be provided to seal between the wellhead 56 and the mandrel casing hanger 50.

Once the final casing string 52 is installed through the bowl profile 26, the offset casing hanger 30 and oversize casing 32 may be removed and a drilling riser 68 installed over the bowl profile 24. The drilling riser 68 may be the same as the drilling riser 40 used in the previous steps and is accordingly secured to the base plate 16 in a similar fashion. A well bore is then drilled through the well slot 24 for the final casing string. As shown most clearly in FIG. 7, the truncated portions of the flanges of the drilling riser 68 and the wellhead 56 cooperate to allow very close center-to-center spacing between these two components. The truncated portions of the flanges preferably comprise opposing milled faces, and a constant gap between the flanges may be established using close tolerance pins (not shown).

Figure 8:
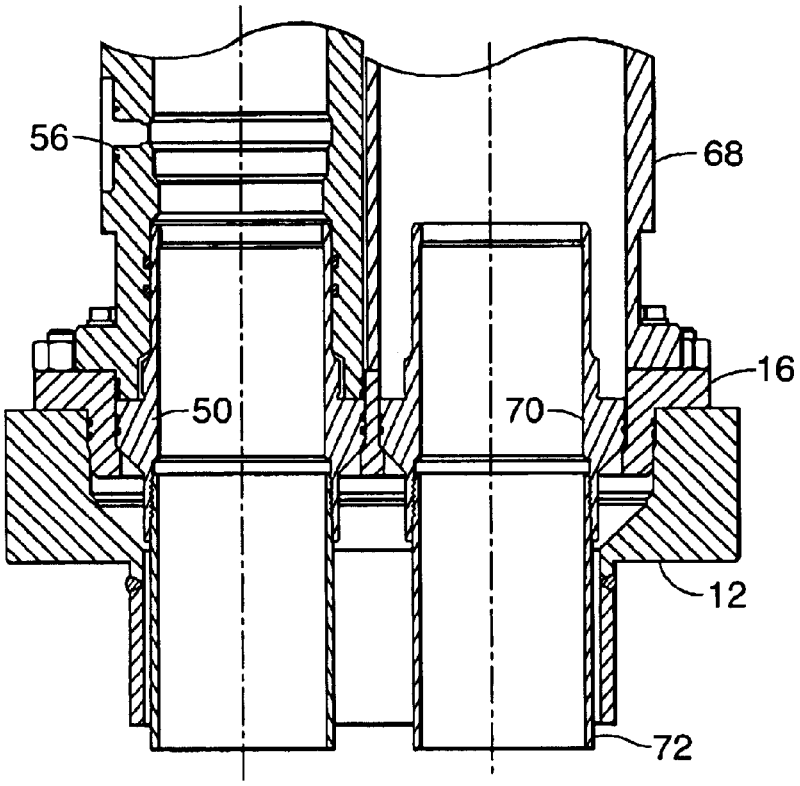
FIGS. 8 and 9 are a cross sectional view and a top view, respectively, of the drilling alignment system of FIG. 2 showing a mandrel casing hanger being installed in the right-hand well slot through the drilling riser.
Figure 9:
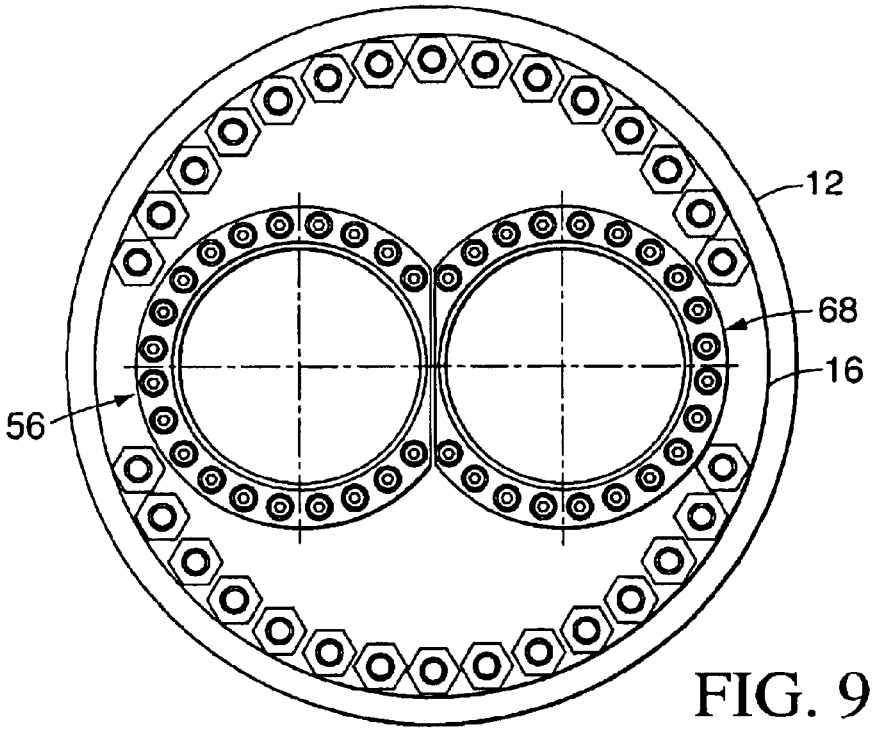
Figure 10:
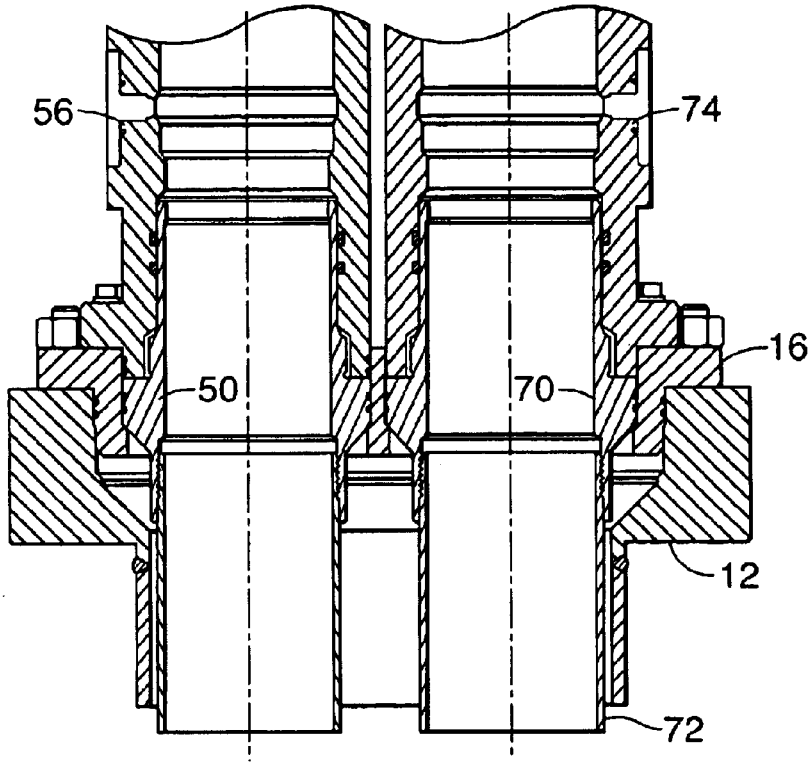
FIGS. 10 and 11 are a cross sectional view and a top view, respectively, of the drilling alignment system of FIG. 2 with a wellhead and a mandrel tubing hanger installed in each well slot.
Figure 11:
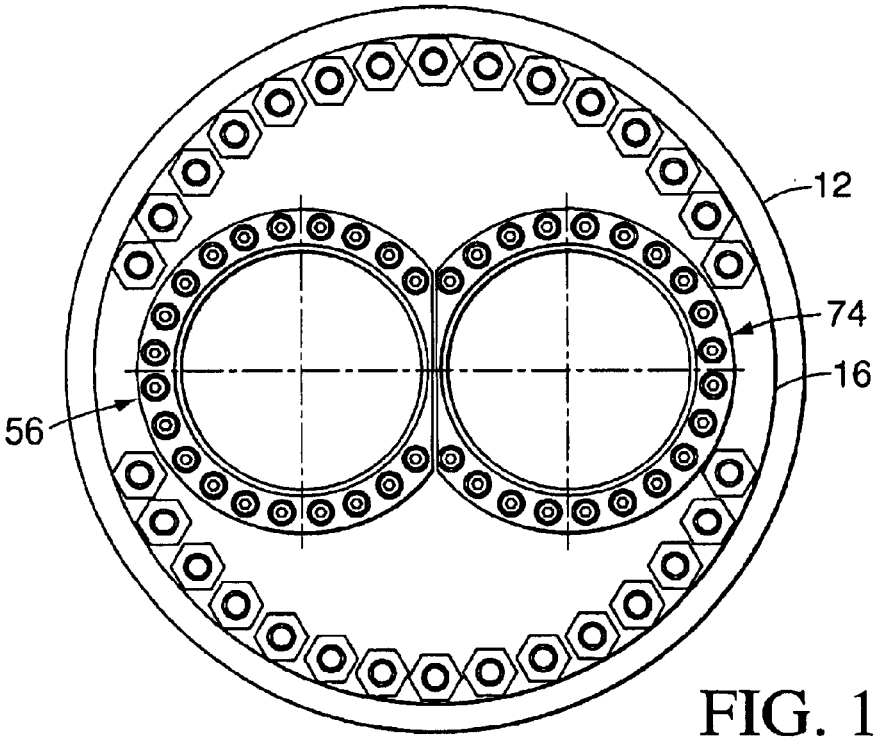

Referring to FIGS. 8 and 9, after the well bore is drilled through the well slot 24, a second mandrel casing hanger 70 suspending a second final casing string 72 is landed in the bowl profile through the drilling riser 68. As shown in FIGS. 10 and 11, the drilling riser 68 is then retrieved and a second wellhead 74 is installed over the mandrel casing hanger 70 in a manner similar to that described above for wellhead 56.

Figure 12:
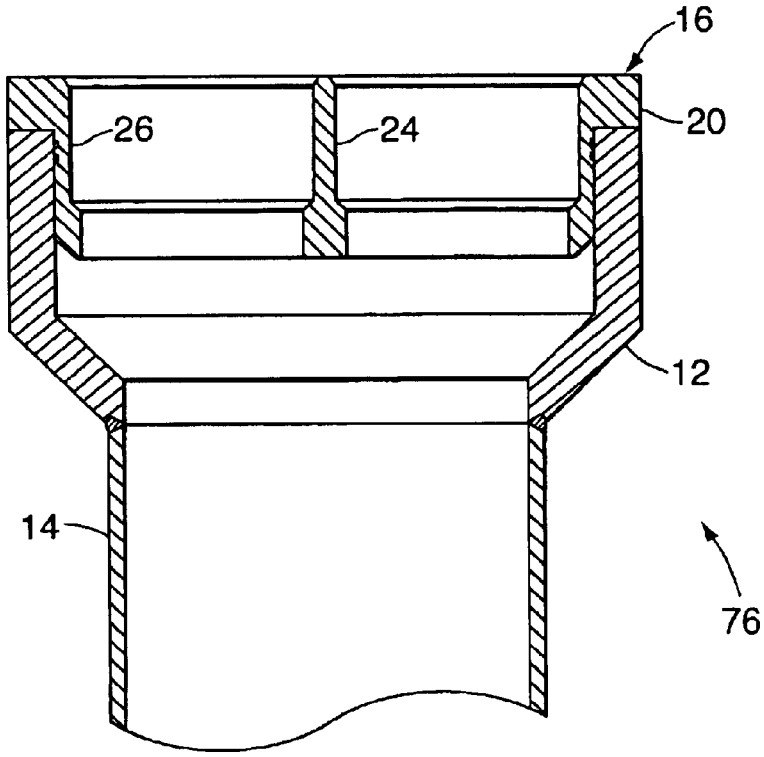
FIGS. 12 and 13 are a cross sectional view and a top view, respectively, of a second embodiment of a drilling alignment system of the present invention with a base plate installed in the drive pipe housing component of the invention.
Figure 13:
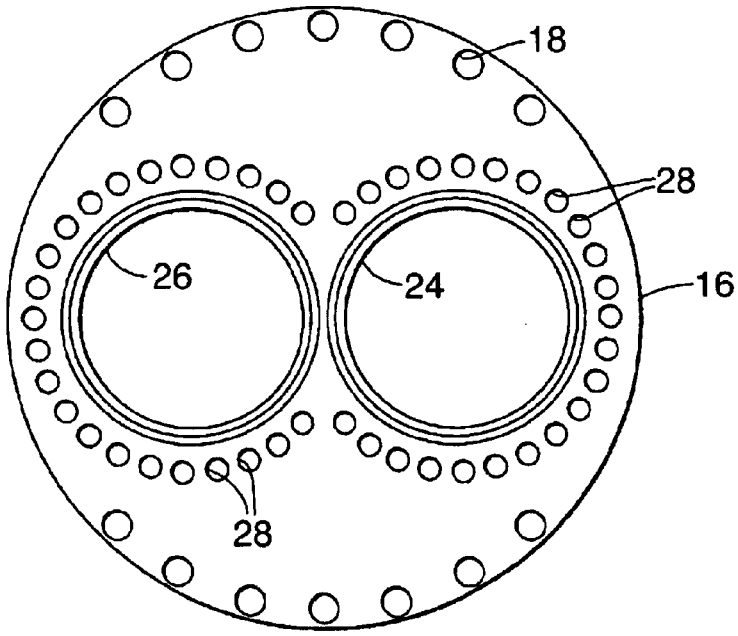

A second embodiment of the invention will now be described with reference to FIGS. 12 through 22. Referring first to FIGS. 12 and 13, the drilling alignment system according to this embodiment may be used in conjunction with an SXS wellhead system 76 which comprises a drive pipe housing 12 that is attached to a conductor housing or pipe 16 by suitable means, such as welding. A base plate 16 is connected to the drive pipe housing 12, preferably with a number of studs and nuts 18. As in the previous embodiment, the base plate 16 includes an annular lip 20 by which it may be suspended in the drive pipe housing 12 and two annular bowl profiles 24 and 26, each of which is formed by a bore that extends through the base plate and defines a corresponding well slot therein. The base plate 16 is ideally sealed to the drive pipe housing 12 by a number of preferably elastomeric seals 22, and a number of tapped holes 28 are formed in the top of the base plate for reasons which will be made apparent below.

Figure 14:
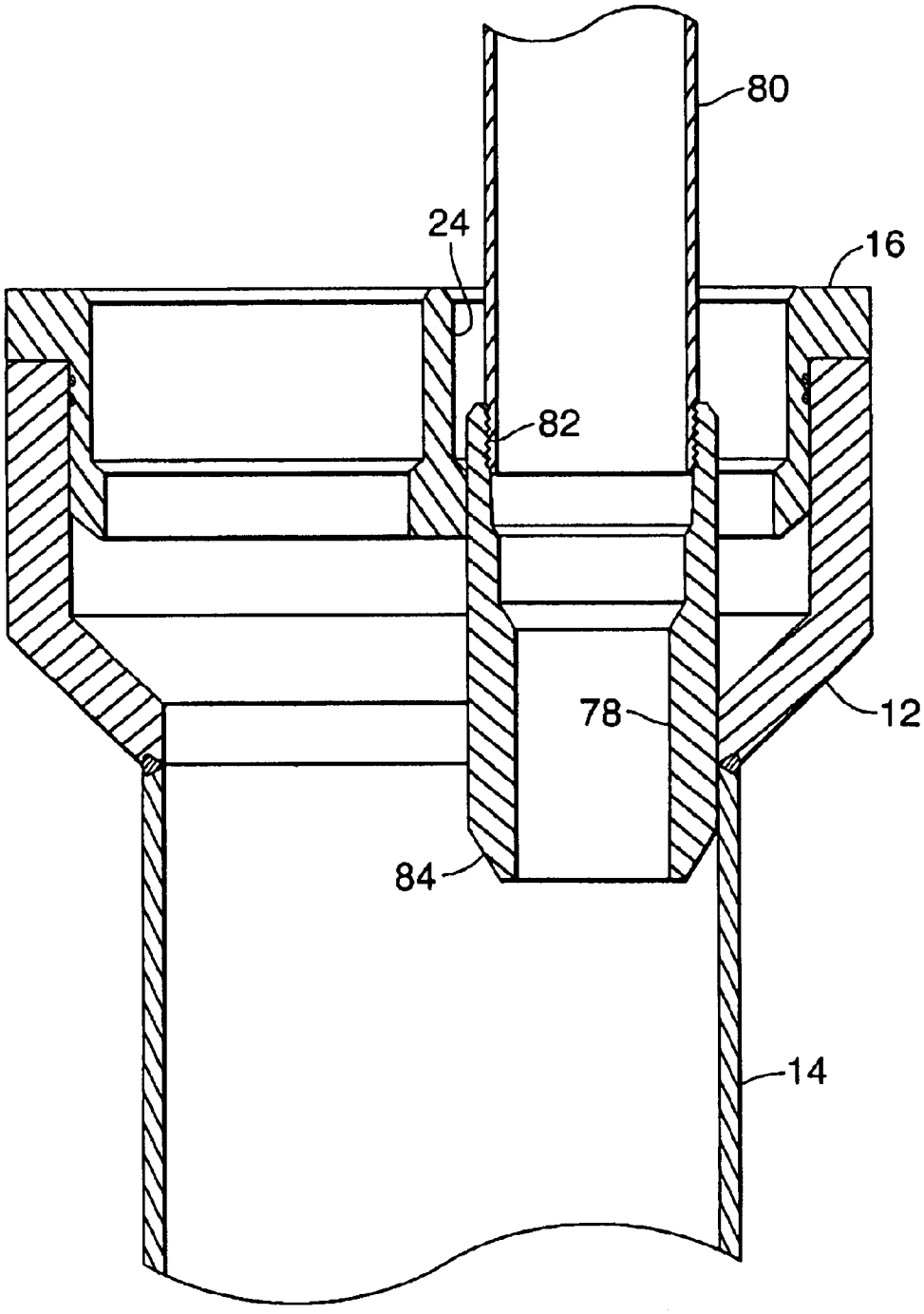
FIG. 14 is a cross sectional view of the drilling alignment system of FIG. 12 showing an end cap guide being installed through the right-hand well slot.
Figure 15:
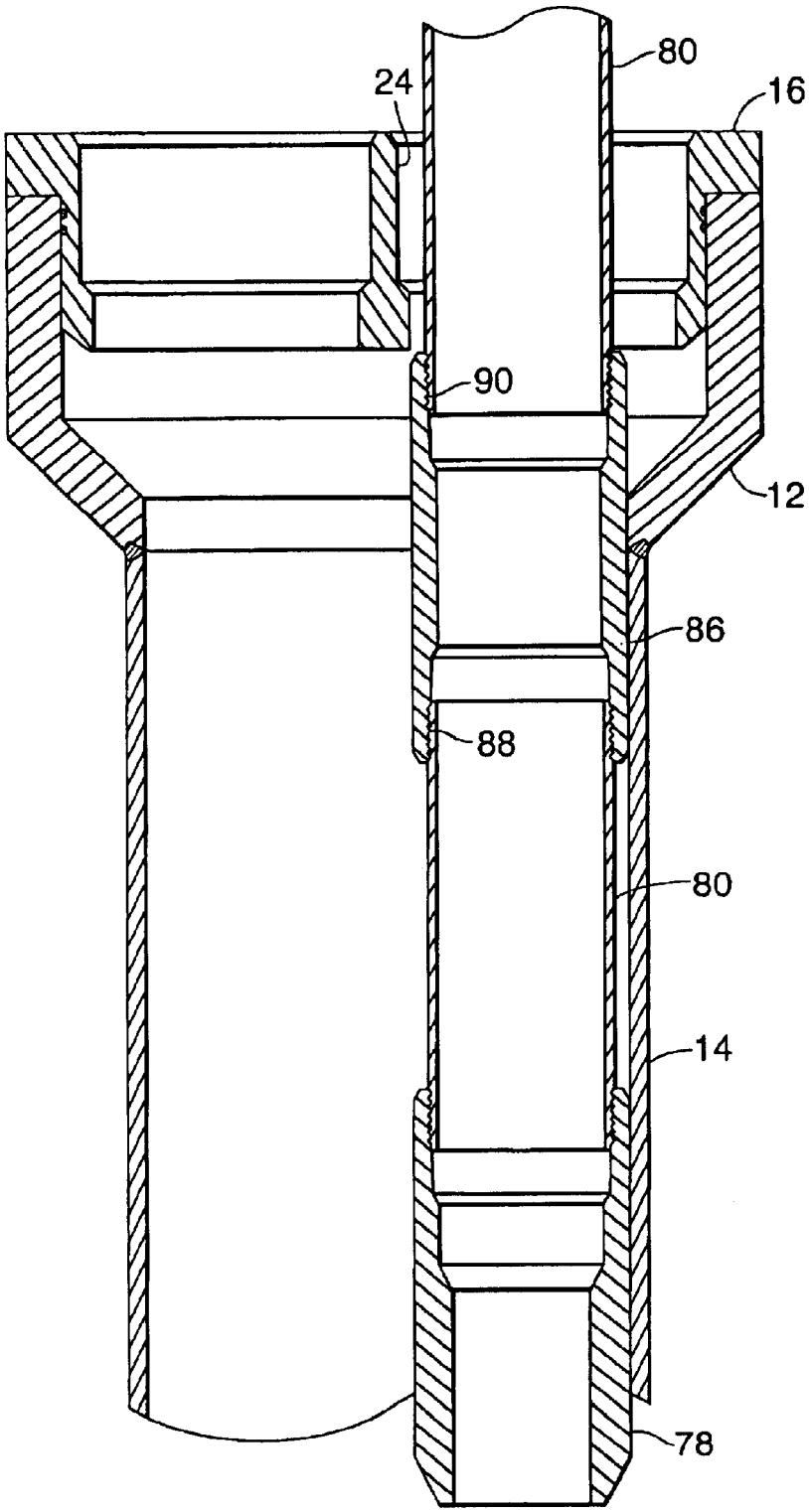
FIG. 15 is a cross sectional view of the drilling alignment system of FIG. 12 showing a first connector collar being installed through the right-hand well slot.

Referring to FIG. 14, after an initial bore is optionally drilled through the well slot 24, an oversized end cap guide 78 is threaded onto a length of oversize casing string 80 generally at 82 and lowered into the conductor pipe 14 through the well slot. The end cap guide 78 is ideally provided with a chamfer 84 at its lower end to help prevent the end cap guide from becoming snagged or hung up as it progresses downhole. As shown in FIG. 15, as the oversize casing string 80 is lowered into the conductor pipe 14, the individual lengths of casing are connected together with oversized connector collars 86, each of which is threadedly connected to the length of casing below generally at 88 and to the length of casing above generally at 90.

Figure 16:
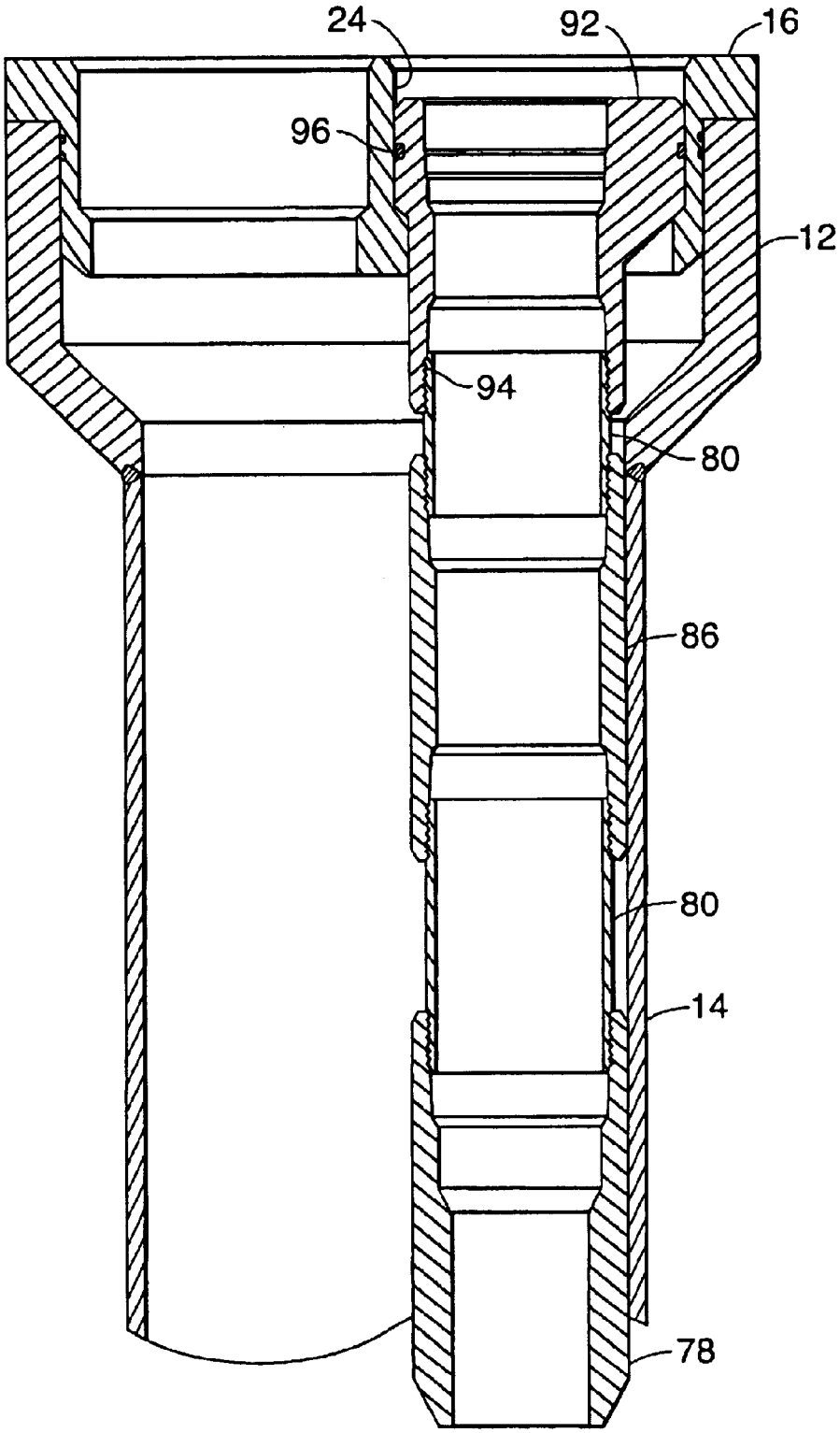
FIG. 16 is a cross sectional view of the drilling alignment system of FIG. 12 showing an offset casing hanger being installed in the right-hand well slot.

Referring to FIG. 16, once the desired length of oversize casing 80 has been run, an offset casing hanger 92 is threadedly connected to the uppermost length of casing generally at 94 and then landed in the bowl profile 24 in the base plate 16. The offset casing hanger 92 is machined off-center and is oriented in the bowl profile 24 via a conventional key and slot arrangement (not shown). In addition, the offset casing hanger 92 is ideally sealed to the bowl profile 24 with a suitable seal, such as a preferably elastomeric belt type packing 96.

As in the previous embodiment, the offset casing hanger 92 and the oversized casing 80 ensure that sufficient space exists to drill out, run and set a final casing string in the well slot 24 after a first well bore has been drilled through the well slot 26. Moreover, the end cap guide 78 and the connector collars 86 also serve to occupy the space that would be normally required for drilling the bore for the final casing string. The offset casing hanger 92 and its associated components preferably remain suspended in the well slot 24 until such time the well is reclaimed for completion.

Figure 17:
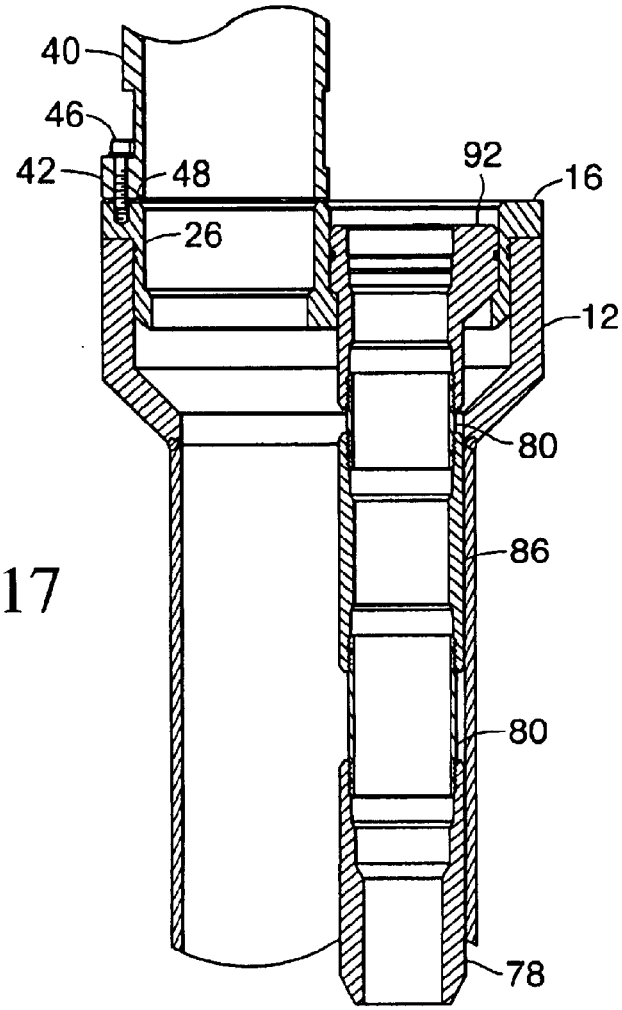
FIGS. 17 and 18 are a cross sectional view and a top view, respectively, of the drilling alignment system of FIG. 12 with a drilling riser installed over the left-hand well slot.
Figure 18:
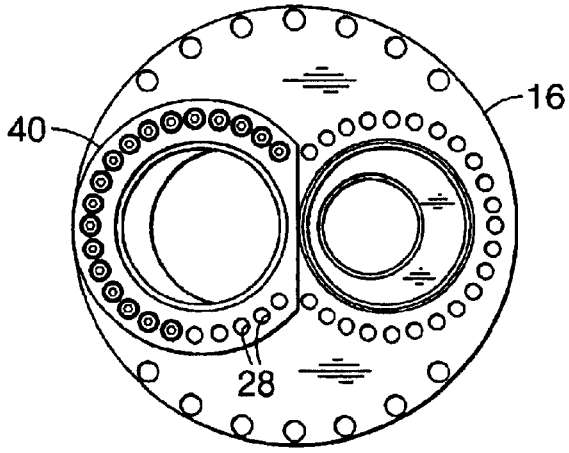

Referring now to FIGS. 17 and 18, after the offset casing hanger 92 has been installed in the well slot 24, a drilling riser 40 is lowered over the empty bowl profile 26. The drilling riser comprises a generally D-shaped bottom flange 42 which is aligned with the bolt holes 28 on the base plate 16 and secured thereto with a number of bolts 46. The drilling riser 40 permits the drilling out of a well bore and the running of the final casing through the well slot 26. An elastomeric face seal 48 is preferably provided to seal between the drilling riser 40 and the base plate 16 during drilling of the well bore.

Figure 19:
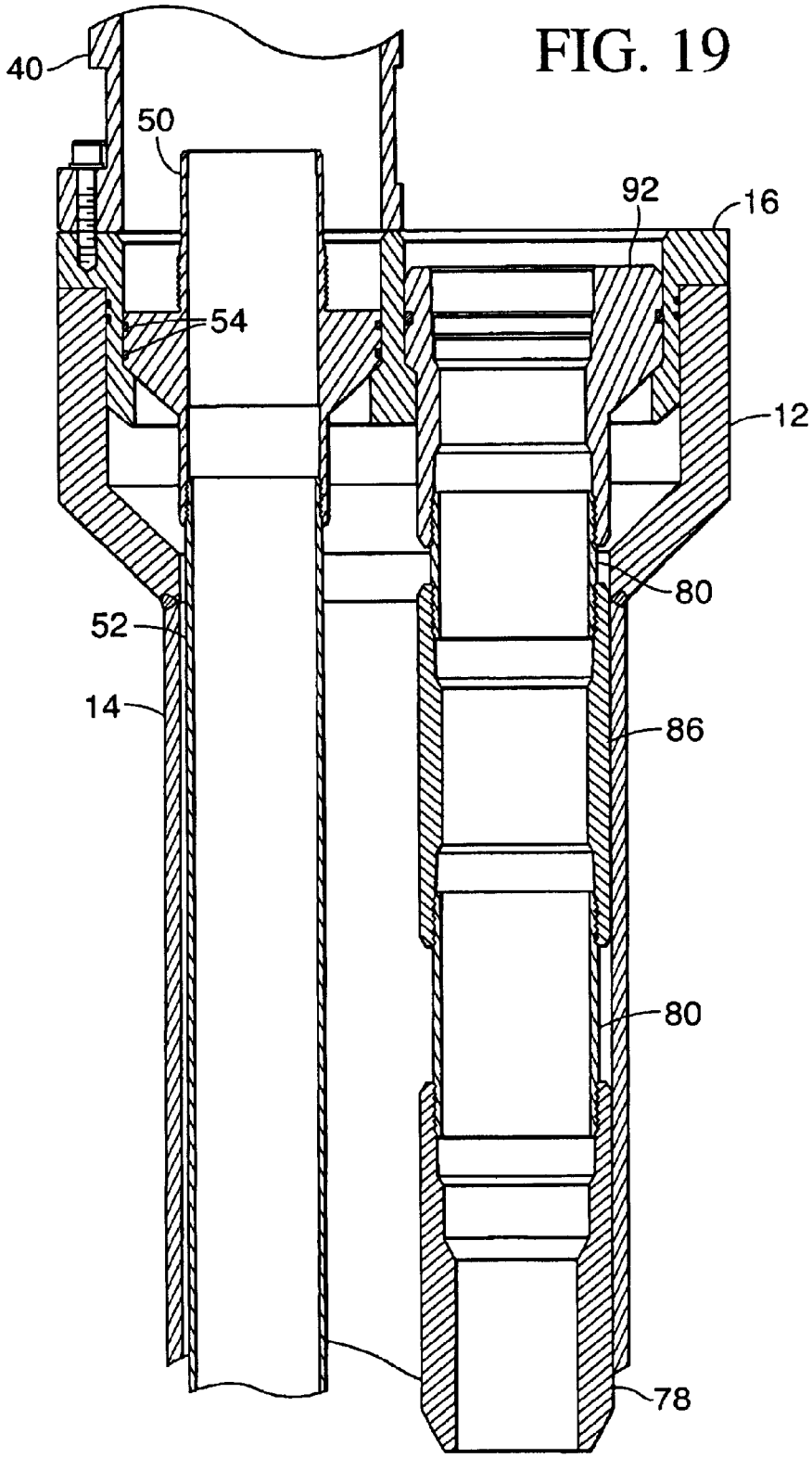
FIG. 19 is a cross sectional view of the drilling alignment system of FIG. 12 showing a mandrel casing hanger being installed in the left-hand well slot through the drilling riser.

As shown in FIG. 19, a mandrel casing hanger 50 is subsequently landed in the bowl profile 26 through the drilling riser 40. The mandrel casing hanger 50 is machined concentric about its centerline and suspends a final casing string 52 within the conductor pipe 14. In addition, a number of preferably elastomeric seals 54 are ideally provided to seal between the mandrel casing hanger 52 and the bowl profile 26.

Figure 20:
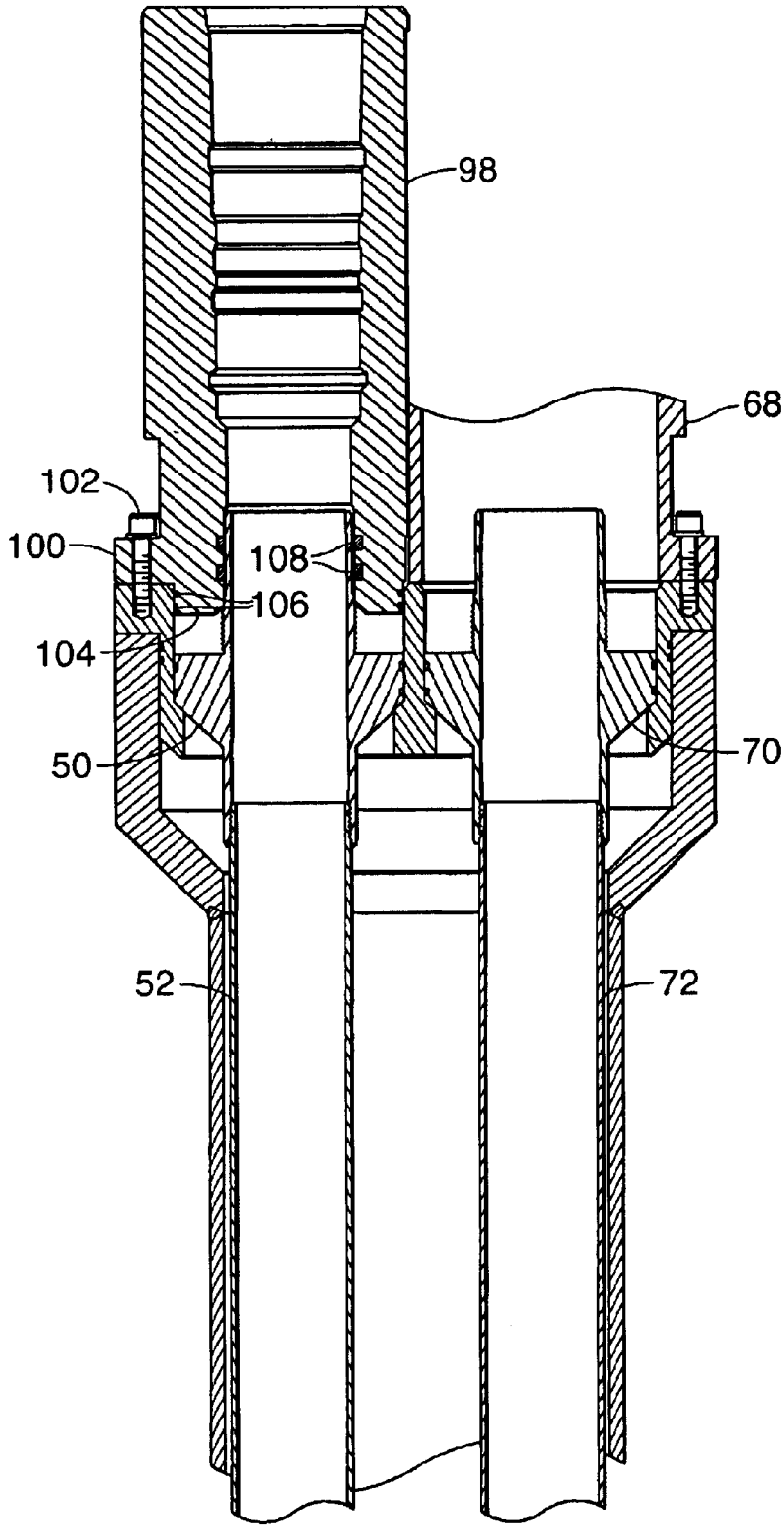
FIG. 20 is a cross sectional view of the drilling alignment system of FIG. 12 with a wellhead installed over the left-hand well slot, a mandrel casing hanger installed in the right-hand well slot and a drilling riser installed over the right-hand weld slot.

Referring now to FIG. 20, after the drilling riser 40 is retrieved, a wellhead 98 is landed over the mandrel casing hanger 50. The wellhead 98 comprises a bottom flange 100 which is aligned with the bolt holes 28 in the base plate 16 and secured thereto with a number of bolts 102. In addition, the wellhead 98 includes a depending nose portion 104 that is sealed to the bowl profile 26 by a number of suitable seals 106. A number of suitable seals 108 may also be provided to seal the wellhead 98 to the mandrel casing hanger 50.

Once the final casing 52 is installed through the well slot 26, the offset casing hanger 92, including the oversized casing string 80, the oversized end cap guide 78 and the oversized connector collars 86, can be removed from the well slot 24. A drilling riser 68 is then installed over the well slot 24. The drilling riser 68 may be the same as the drilling riser 40 used in the previous steps and is accordingly secured to the base plate 16 in a similar fashion. A well bore is then drilled through the well slot 24 for the final casing string. As in the previous embodiments, the bottom flanges of the drilling riser 68 and the wellhead 98 may comprise truncated portions which cooperate to allow very close center-to-center spacing between these two components. These truncated portions preferably comprise opposing milled faces, and a constant gap between the flanges may be established using close tolerance pins (not shown).

Figure 21:
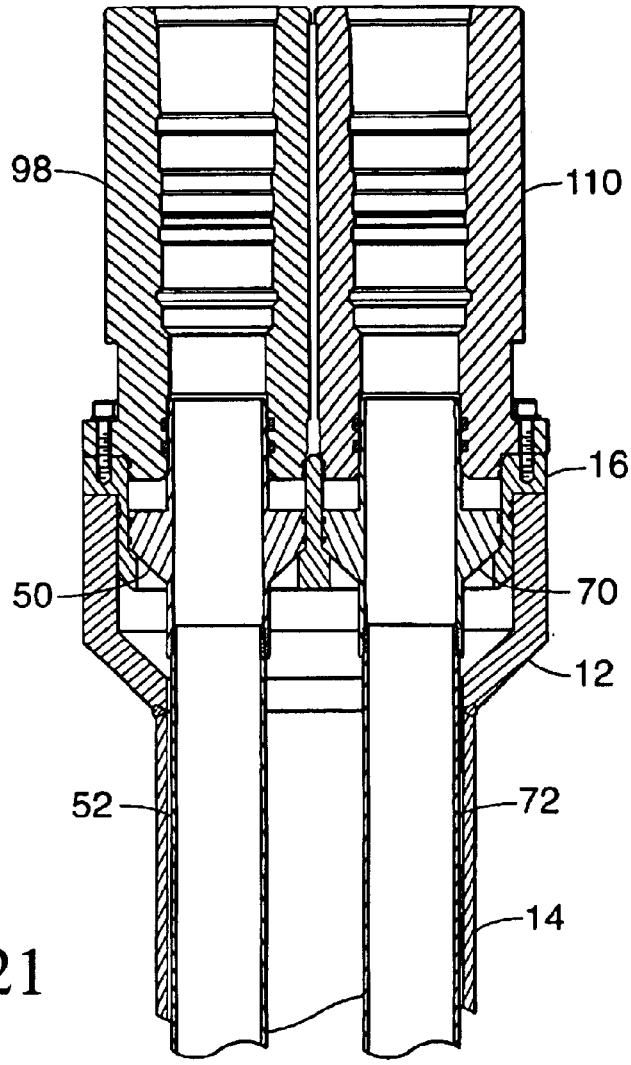
FIGS. 21 and 22 are a cross sectional view and a top view, respectively, of the drilling alignment system of the present invention with a wellhead installed over both well slots.
Figure 22:
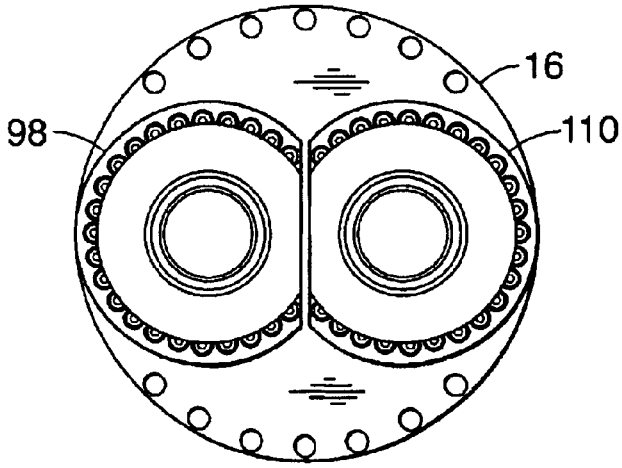

Referring still to FIG. 20, after the well bore is drilled through the well slot 24, a second mandrel casing hanger 70 suspending a second final casing string 72 is landed into the well slot through the drilling riser 68. As shown in FIGS. 21 and 22, after the drilling riser 68 is retrieved, a second wellhead 110 is installed over the well slot 24 in a manner similar to that described above for the wellhead 98.

In alternative embodiments, the method and apparatus of the present invention can be used for multiple completion wells having any number of casing strings suspended in a single conductor pipe. It is contemplated that while each well bore is being drilled out, the device of the present invention would be installed in each well bore which has not yet been drilled or completed. This would ensure that each successively completed casing string will not interfere with completion of the remaining strings.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A method for drilling a plurality of well bores through a single conductor housing which comprises:

providing a base plate which includes at least first and second well slots that extend therethrough;

supporting the base plate on the conductor housing;

suspending a temporary casing string from the first well slot;

drilling a first well bore through the second well slot;

removing the temporary casing string from the first well slot; and drilling a second well bore through the first well slot.

2. The method of claim 1, wherein the diameter of the temporary casing string is larger than the diameter of a casing string which is subsequently suspended in the first well slot during completion of a well through the second well bore.

3. The method of claim 1, further comprising drilling an initial bore through the first well slot prior to suspending the temporary casing string from the first well slot.

4. The method of claim 1, further comprising attaching an upper end of the temporary casing string to a casing hanger which in turn is landed in the first well slot.

5. The method of claim 4, wherein the casing hanger comprises an offset casing hanger.

6. The method of claim 4, further comprising attaching an end cap guide to a lower end of the temporary casing string prior to suspending the casing string from the first well slot.

7. The method of claim 6, wherein the diameter of the end cap guide is larger than the diameter of the casing string.

8. The method of claim 4, further comprising:

constructing the temporary casing string from a number of individual lengths of casing string; and connecting each pair of adjacent lengths of casing string together with a connector collar.

9. The method of claim 8, wherein the diameter of the connector collars is larger than the diameter of the individual lengths of casing string.

10. A method for completing a plurality of wells through a single conductor housing which comprises:

providing a base plate which includes at least first and second well slots that extend therethrough;

supporting the base plate on the conductor housing;

suspending a temporary casing string from the first well slot;

mounting a first drilling riser to the base plate over the second well slot;

drilling a first well bore through the first drilling riser and the second welt slot;

suspending a first casing string in the second well slot; and removing the temporary casing string from the first well slot.

11. The method of claim 10, further comprising:

removing the first drilling riser from the base plate; and mounting a first wellhead to the base plate over the second well slot.

12. The method of claim 11, further comprising:

mounting a second drilling riser to the base plate over the first well slot;

drilling a second well bore through the second drilling riser and the first well slot; and suspending a second casing string in the first well slot.

13. The method of claim 12, further comprising:

removing the second drilling riser from the base plate; and mounting a second wellhead to the base plate over the first well slot.

14. The method of claim 10, further comprising:

mounting a second drilling riser to the base plate over the first well slot; and drilling a second well bore through the second drilling riser and the first well slot; and suspending a second casing string in the first well slot.

15. The method of claim 14, further comprising:

removing the second drilling riser from the base plate; and mounting a wellhead to the base plate over the first well slot.

* * * * *